US006590327B2

(12) United States Patent
Furusawa et al.

(10) Patent No.: US 6,590,327 B2
(45) Date of Patent: Jul. 8, 2003

(54) COLOR CATHODE RAY TUBE HAVING FLAT OUTER FACE

(75) Inventors: Takeharu Furusawa, Mobara (JP); Nobuhiko Hosotani, Mobara (JP); Mutsumi Maehara, Mobara (JP)

(73) Assignee: Hitachi Ltd., Tokyo (JP)

( * ) Notice: Subject to any disclaimer, the term of this patent is extended or adjusted under 35 U.S.C. 154(b) by 0 days.

(21) Appl. No.: 09/846,628

(22) Filed: May 1, 2001

(65) Prior Publication Data

US 2002/0195920 A1 Dec. 26, 2002

(51) Int. Cl.[7] ..... H01J 29/80

(52) U.S. Cl. ..... 313/402; 313/407; 313/408; 313/440; 313/413; 313/421; 313/461

(58) Field of Search ..... 313/409, 413, 313/402, 408, 421, 461, 440, 407

(56) References Cited

U.S. PATENT DOCUMENTS

| | | | | |
|---|---|---|---|---|
| 4,623,818 | A | 11/1986 | Yamazaki | |
| 5,631,520 | A | 5/1997 | Inoue et al. | |
| 6,268,690 | B1 | 7/2001 | Yamazaki | |
| 6,373,202 | B1 * | 4/2002 | Ito et al. | 313/440 |

FOREIGN PATENT DOCUMENTS

| | | |
|---|---|---|
| EP | 1 035 558 A1 | 9/2000 |
| EP | 1 089 313 A2 | 4/2001 |
| EP | 1 091 381 A2 | 4/2001 |
| EP | 1 154 458 A2 | 11/2001 |
| TW | 346636 | 12/1998 |
| TW | 359844 | 6/1999 |

OTHER PUBLICATIONS

European Search Report 01 11 0151, Sep. 25, 2002.

* cited by examiner

*Primary Examiner*—David Martin
*Assistant Examiner*—Thanh Y. Tran
(74) *Attorney, Agent, or Firm*—Milbank, Tweed, Hadley & McCloy LLP

(57) ABSTRACT

A color cathode ray tube comprises a panel which outside surface is flat and inside surface has curvature, and a pressed shadow mask having a curved surface opposed to the panel inside surface. The curved surface of the shadow mask is such that the radius of curvature decreases approximately linearly as the position moves from the center to the periphery. Radii of curvature on the major axis, minor axis, and diagonal axis at positions having the same distance from the shadow mask center do not have large differences. This configuration can increase the mechanical strength of the shadow mask.

17 Claims, 6 Drawing Sheets

COLOR CATHODE RAY TUBE HAVING FLAT OUTER FACE

FIELD OF THE INVENTION

The present invention relates to a color cathode ray tube, and particularly to a shadow mask with its shape of a curved surface in an apertures region thereof.

BACKGROUND OF THE INVENTION

The legibility of a picture can be improved by making the panel outside surface flat. If the panel outside surface is made flat, the panel inside surface becomes close to a flat surface. Since the shadow mask should be approximately parallel with the curved panel inside surface, the shadow mask also becomes approximately flat. Since the shadow mask is formed by pressing, it is stronger when it has larger curvature (i.e., it is weaker when it is closer to a flat member). Therefore, in color picture tubes having a flat outside surface, insufficient strength of the shadow mask is a serious problem.

U.S. Pat. No. 4,136,300 (Morrell) discloses a technique of suppressing doming by making the curvature of the shadow mask larger that that of the panel inside surface by changing the shadow mask pitch in the screen peripheral portion from that at the screen center.

JP-A-51-47365 discloses that, to closely arrange phosphor dots on the panel inside surface, the panel inside surface or the shadow mask is formed by a plurality of concentric spherical surfaces or the radius of curvature of the panel inside surface or the shadow mask is varied clockwise in a plane that is perpendicular to the tube axis.

U.S. Pat. No. 4,839,556 (Regland) discloses a technique of suppressing doming by making the curvature in the screen peripheral portion larger than that at the screen center on the major axis of the shadow mask.

SUMMARY OF THE INVENTION

However, the U.S. Pat. No. 4,136,300 does not disclose how to change the shadow mask pitch in the screen peripheral portion from that at the screen center. If the shadow mask pitch in the screen peripheral portion were made too larger than that at the screen center, the resolution would decrease unduly in the screen peripheral portion.

Further, neither of the above techniques cannot provide sufficient mask strength for color cathode ray tubes whose panel has a flat outside surface.

According to a first aspect of the invention, in a color cathode ray tube whose panel has a flat outside surface, the radius of curvature of the shadow mask curved surface decreases approximately linearly as the position moves from the center to the periphery.

Decreasing the radius of curvature approximately linearly can increase the strength of the shadow mask.

According to a second aspect of the invention, in a color cathode ray tube whose panel has a flat outside surface, the radius of curvature of the shadow mask curved surface decreases as the position moves from the center to the periphery and radii of curvature on the screen major axis, minor axis, and diagonal axis at positions on a circle centered by the shadow mask center and having an arbitrary radius do not have large differences.

This can also increase the strength of the shadow mask.

DESCRIPTION OF THE PREFERRED EMBODIMENTS

Figure 1:
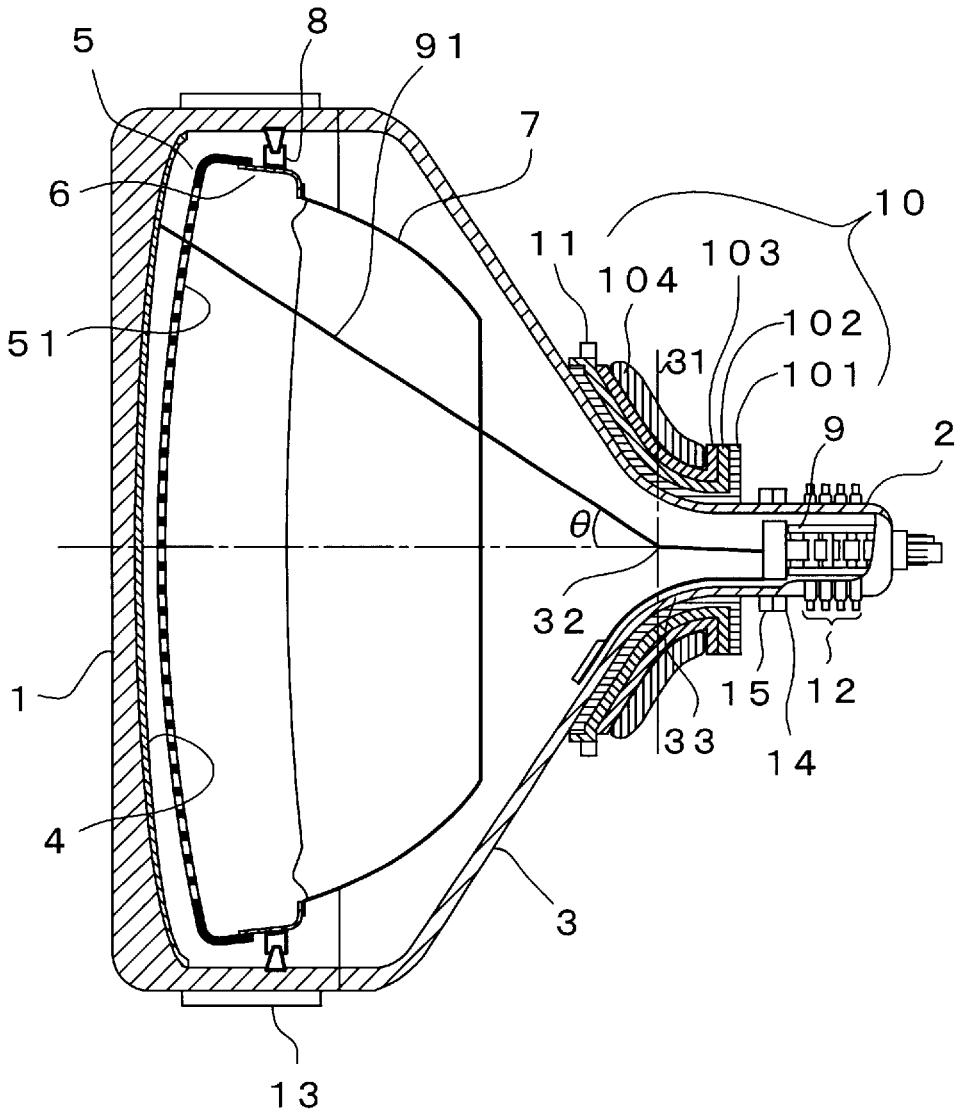
FIG. 1 is a sectional view of a color cathode ray tube according to the present invention.

FIG. 1 is a schematic sectional view of a color cathode ray tube having a flat outside surface.

The outside surface of a panel 1 is flat and its inside surface is curved. The reason why the panel inside surface has curvature is to curve a shadow mask 5 that is opposed to the panel inside surface. A neck 2 accommodates an in-line electron gun 9 and is joined to the panel 1 via a funnel 3.

An intersecting point 32 of a reference line 31 and the tube axis is defined as a deflection center. An angle formed by the tube axis and a line that connects the deflection center 32 and a point where an electron beam 91 strikes a phosphor screen 4 is defined as a deflection angle. The reference line 31, which is a base of designing of a color picture tube, is set on the panel side of a sealing position of the neck 2 and the funnel 3. A maximum deflection is defined as twice an angle that is formed by the tube axis and a line that connects the deflection center 32 and the diagonal end of an effective screen on the panel inside surface. In this embodiment, the maximum deflection angle is about 90°.

Phosphor dots constitute the phosphor screen 4. The shadow mask 5 has an area 51 (apertures area) where a number of holes are formed and it is supported by a support frame 6. The support frame 6 is attached to the panel 1 by means of springs 8. An internal magnetic shield 7 is placed on the support frame 6.

A deflection yoke 10 for deflecting electron beams 91 is mounted on a cone portion 33 of the funnel 3. The main components of the deflection yoke 10 are a horizontal deflection coil 101, a separator 102, a vertical deflection yoke 103, and a core 104. Bar-shaped magnets 11 for correcting raster distortion and convergence are provided above and below the horizontal deflection coil 101. A magnet assembly 12 adjusts purity and convergence of electron beams.

A tension band 13 prevents bulb implosion.

First electromagnetic quadruple coils 14 and second electromagnetic quadruple coils 15 are disposed between the deflection yoke 10 and the magnet assembly 12 for adjusting the orbit of the side electron beams among three electron beams arranged in-line.

The panel outer diagonal size is 49 cm and the screen effective diameter is 46 cm. The outside surface of the panel 1 is flat or has a very large radius of curvature.

Figure 2:
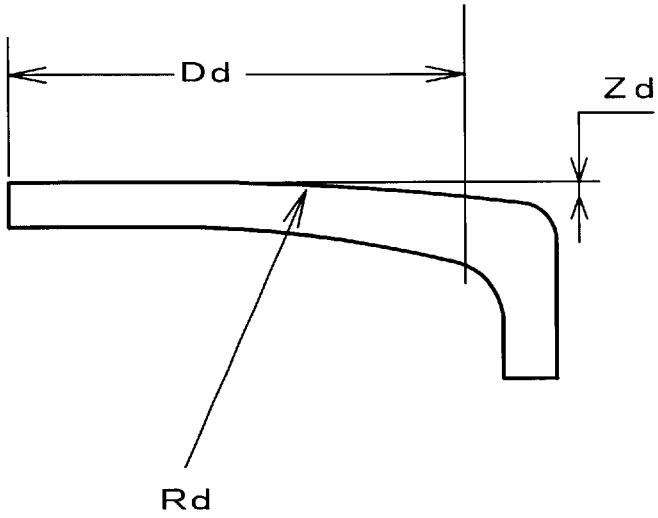
FIG. 2 shows a definition of the equivalent radius of curvature of a panel.

As shown in FIG. 2, the flatness of the panel 1 can be evaluated by using the equivalent radius of curvature that is a function of a drop on a line parallel with a tube axis in the diagonal axis direction of the screen. As shown in FIG. 2, the equivalent radius Rd of curvature in the diagonal axis direction is given by $Rd=(Dd^2+Zd^2)/2Zd$, where Dd is a half of the effective diameter in the diagonal axis direction and Zd is the drop. If the equivalent radius Rd of curvature in the diagonal axis direction of the panel outside surface is greater than or equal to 10,000 mm, it is substantially flat.

The influence of the radius of curvature on the flatness depends on the screen size. In view of this, there is a normalized expression of the flatness of a panel surface. Specifically, the flatness is expressed in terms of a multiple of a reference (1 R) that is as follows:

$$Ro=42.5V+45.0 \text{ mm (for the outside surface)}$$

$$Ri=40.0V+40.0 \text{ mm (for the inside surface)}$$

V is a numerical value in inch of the screen diagonal effective diameter. It is known that the panel appears almost flat if the radius of curvature of the outside surface is 10 Rs. If the screen diagonal effective diameter of the panel is 18 inches, the radius of curvature corresponding to 10 Rs is equal to 8,100 mm. The outside surface appears almost completely flat if the radius of curvature of the outside surface is 20 Rs. If the diagonal effective diameter of the panel is 18 inches, the radius of curvature corresponding to 20 Rs is equal to 16,200 mm.

In this embodiment, the curved surface Zo (the drop on a line parallel with a tube axis) of the panel outside surface at a position (X, Y) is expressed by the following definitive equation:

$$Zo(X,Y)=Rx-\sqrt{[\{Rx-Ry+\sqrt{(Ry^2-Y^2)}\}^2-X^2]}$$

Rx=50,000 mm (the equivalent radius of curvature in the major axis direction of the panel outside surface)

Ry=80,000 mm (the equivalent radius of curvature in the minor axis direction of the panel outside surface).

In this embodiment, the equivalent radius of curvature in the diagonal axis direction of the panel outside surface is equal to 62,500 mm and hence the panel outside surface is almost flat.

According to another method, a curved surface of a panel surface at a position (X, Y) is obtained by determining coefficients A1–A8 of the following equation:

$$Z=A1X^2+A2X^4+A3Y^2+A4Y^4+A5X^2Y^2+A6X^4Y^2+A7X^2Y^4+A8X^4Y^4$$

Z is the drop on a line parallel with a tube axis from the height at the panel center.

Where the panel outside surface is flat, there is a limit to which the curvature of the panel inside surface can be increased and also the shadow mask becomes close to a flat member. In the invention, a measure is taken in the curved surface of the shadow mask to maintain sufficient mechanical strength even if it becomes close to a flat member.

A curved surface of a shadow mask at a position (X, Y) is obtained by determining coefficients M1–M8 of the following polynomial:

$$Zm=M1X^2+M2X^4+M3Y^2+M4Y^4+M5X^2Y^2+M6X^4Y^2+M7X^2Y^4+M8X^4Y^4.$$

Figure 3:
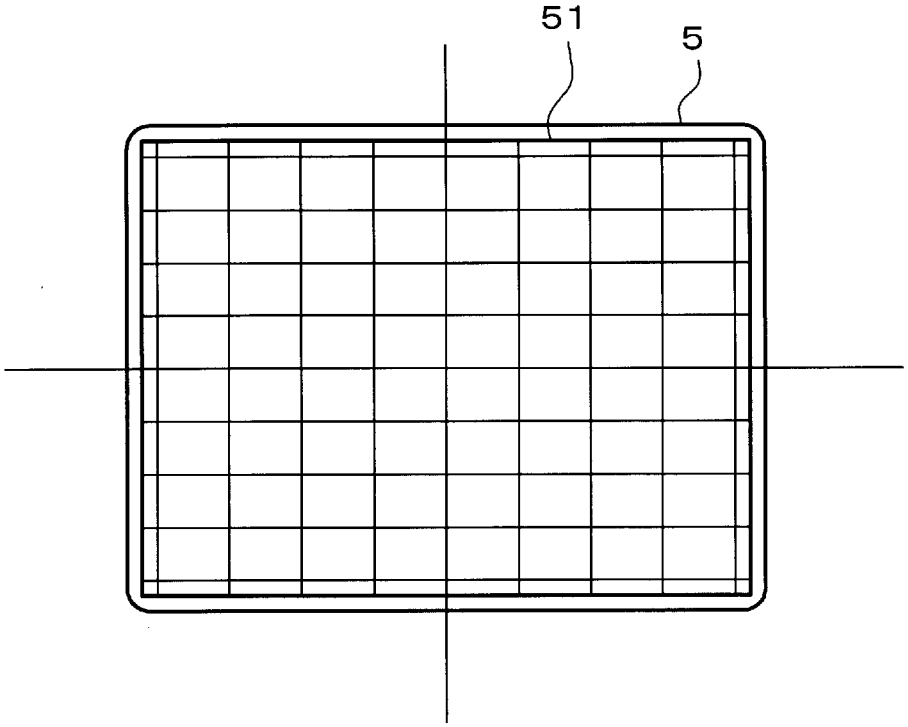
FIG. 3 shows an example of measurement positions that are used in determining a shadow mask curved surface.

In this embodiment, the coefficients M1–M8 of the curved surface of the shadow mask are as shown in Table 1. The coefficients M1–M8 shown in Table 1 are ones obtained by measuring a curved surface after the pressed shadow mask 5 was combined with the support frame 6. For example, the coefficients M1–M8 can be determined based on relationships between the positions (X, Y) of respective nodes that are produced by dividing the shadow mask effective area 51 into meshes as shown in FIG. 3 and drops Zm from the height at the mask center.

TABLE 1

| | |
|---|---|
| M1 | 0.2706E−03 |
| M2 | 0.3691E−09 |
| M3 | 0.2903E−03 |
| M4 | 0.1747E−09 |
| M5 | 0.1100E−09 |
| M6 | 0.9453E−14 |
| M7 | 0.6825E−13 |
| M8 | −0.1260E−17 |

Figure 4:
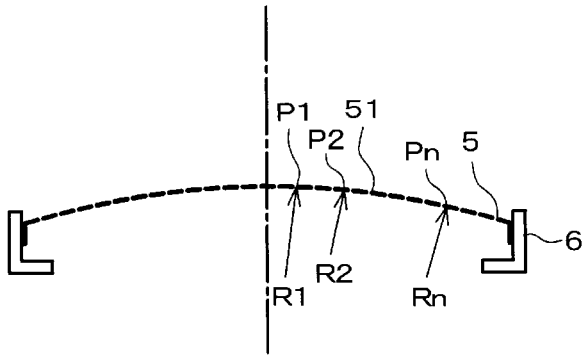
FIG. 4 shows a definition of radii of curvature of a shadow mask in the invention.

FIG. 4 shows a definition of radii of curvature at respective positions P1, P2, etc. in the invention. Symbols R1, R2, etc. in FIG. 4 represent radii of curvature. Table 2 shows radii of curvature of the curved surface of Table 1 at respective positions in each of the screen major axis direction, minor axis direction, and diagonal axis direction. In Table 2, L is the distance from the shadow mask center, Rma is the radius of curvature in the major axis direction, Rmi is the radius of curvature in the minor axis direction, and Rd is the radius of curvature in the diagonal axis direction.

TABLE 2

| L (mm) | Rma (mm) | Rmi (mm) | Rd (mm) |
|---|---|---|---|
| 0 | 1847.5 | 1722.6 | 1800.5 |
| 25 | 1836.6 | 1719.3 | 1796.0 |
| 50 | 1812.5 | 1709.4 | 1779.4 |
| 75 | 1770.8 | 1693.2 | 1744.1 |
| 100 | 1715.7 | 1671.2 | 1683.9 |
| 125 | 1650.4 | 1644.0 | 1599.3 |
| 150 | 1577.7 | | 1501.9 |
| 170 | 1516.4 | | |
| 175 | | | 1413.4 |
| 200 | | | 1364.8 |

Figure 5:
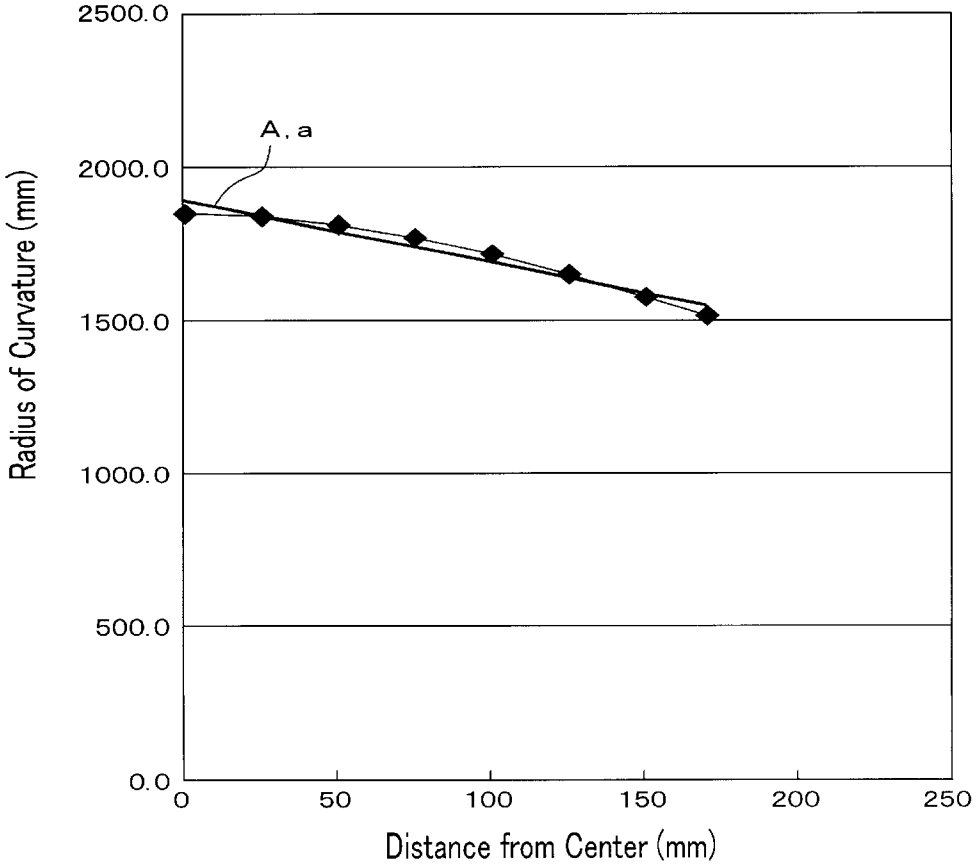
FIG. 5 shows a variation of the radius of curvature of a shadow mask on the major axis in the invention.

FIG. 5 shows a variation of the radius of curvature on the major axis. FIG. 5 also shows a straight line A that was obtained by straight-line-approximating the plotted points by the least-squares method. The straight line A is represented by $y=-2.0103\times+1890.9$, where y is the radius of curvature and x is the distance from the shadow mask center.

Figure 6:
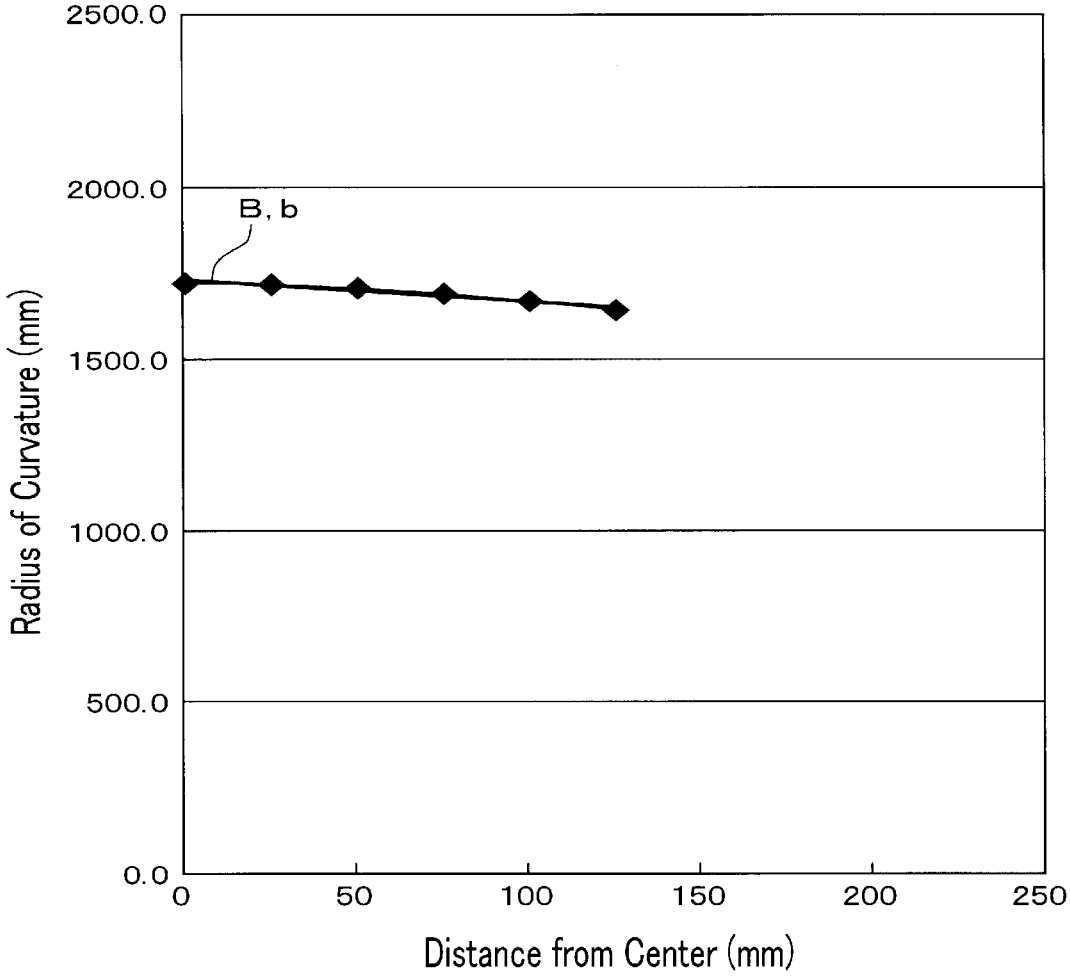
FIG. 6 shows a variation of the radius of curvature of the shadow mask on the minor axis in the invention.

FIG. 6 shows a variation of the radius of curvature on the minor axis. FIG. 6 also shows a straight line B that was obtained by straight-line-approximating the plotted points by the least-squares method. The straight line B is represented by $y=-0.6326\times+1732.8$.

Figure 7:
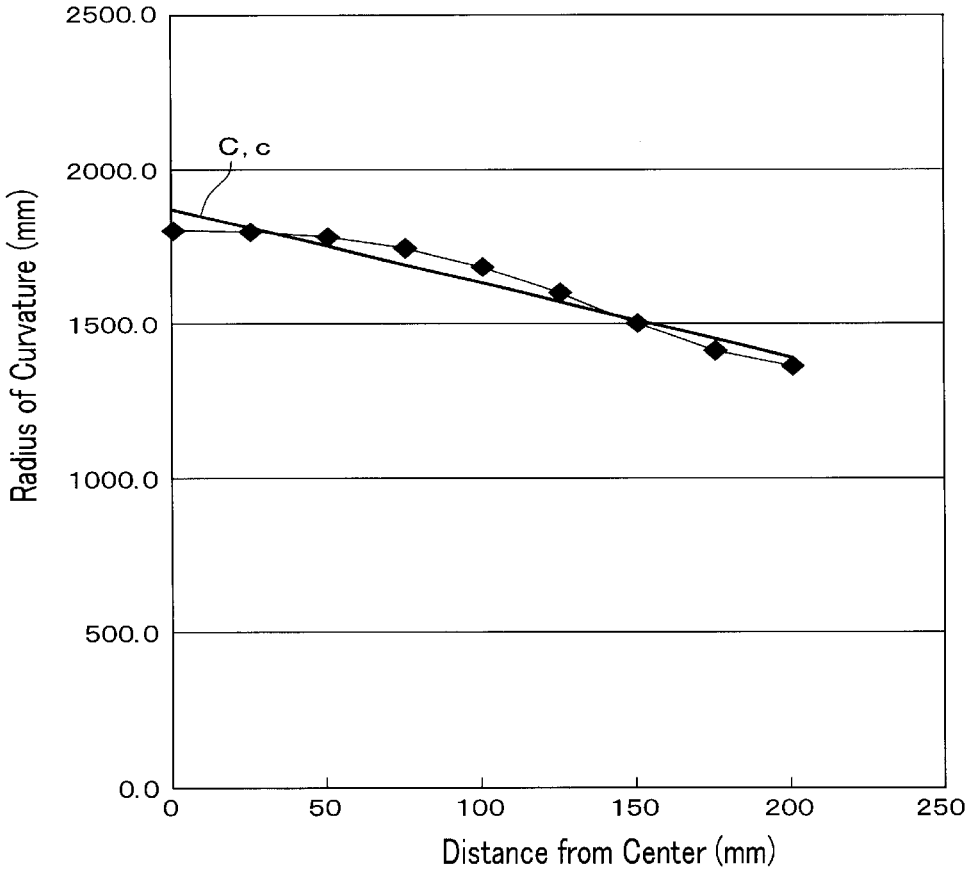
FIG. 7 shows a variation of the radius of curvature of the shadow mask on the diagonal axis in the invention.

FIG. 7 shows a variation of the radius of curvature on the diagonal axis. FIG. 7 also shows a straight line C that was obtained by straight-line-approximating the plotted points by the least-squares method. The straight line C is represented by $y=-2.3937\times+1870.8$.

A first feature of the invention is that the radius of curvature decreases approximately linearly as the position moves from the shadow mask center to the periphery. This prevents occurrence of a portion where the radius of curvature varies steeply and thereby increases the resistance of the shadow mask to a mechanical impact. That is, the shadow mask is stronger when the deviations of the radius-of-curvature curves on the respective axes from their straight line approximations (see FIGS. 5–7) are smaller.

More specifically, a remarkable strength-increasing effect is obtained if the deviations of the radius-of-curvature curves on the respective axes from their straight line approximations A–C (see FIGS. 5–7) are smaller than or equal to 100 mm when the curved surface of the shadow mask is represented by the above-mentioned 8-coefficient polynomial. The deviations of the plotted points of radii of curvature from the straight line approximation are largest on the diagonal axis. In this embodiment, the deviations from the straight line C approximation are smaller than or equal to 100 mm even on the diagonal axis.

Another feature of the invention is that among the straight lines A–C having respective slopes a–c shown in FIGS. 5–7 the straight line C on the diagonal axis has the largest slope. That is, the variation of the radius of curvature is largest in the diagonal axis direction. A relationship c>a>b holds, where a, b, and c are the slopes on the major axis, the minor axis, and the diagonal axis, respectively.

Another feature of the invention is that the slopes of the respective straight lines A–C are small. That is, although the radius of curvature decreases as the position moves from the shadow mask center to the periphery, the difference in radius of curvature is not made unduly large. It is preferable that the absolute value of the slope of each straight line be smaller than or equal to 3.0. In this embodiment, the absolute value of the slope of the straight line in the diagonal axis direction (the slope is steepest in this direction) is approximately equal to 2.4.

Still another feature of the invention is that with the panel having a flat outside surface the radius of curvature of the shadow mask decreases in each of the major axis direction and the minor axis direction as the position goes away from the center, and that the radius of curvature at the center in the minor axis direction is smaller than in the major axis direction. With the panel having a flat outside surface, the issue of shadow mask strength is particularly serious in the minor axis direction. Therefore, employing a small radius of curvature in the minor axis direction in the central portion is effective in increasing the strength of the shadow mask.

A remarkable strength-increasing effect is obtained if the ratio of the radius of curvature in the minor axis direction to that in the major axis direction at the shadow mask center is smaller than or equal to 0.95. In this embodiment, the ratio is approximately equal to 0.93. However, if the ratio is smaller than or equal to 0.9, the difference between the radius of curvature in the minor axis direction and that in the major axis direction may be too large and a resulting unnatural shadow mask curved surface may adversely affect the shadow mask strength.

Yet another feature of the invention is that radii of curvature on the major axis, minor axis, and diagonal axis at positions having the same distance from the shadow mask center do not have large differences.

Figure 8:
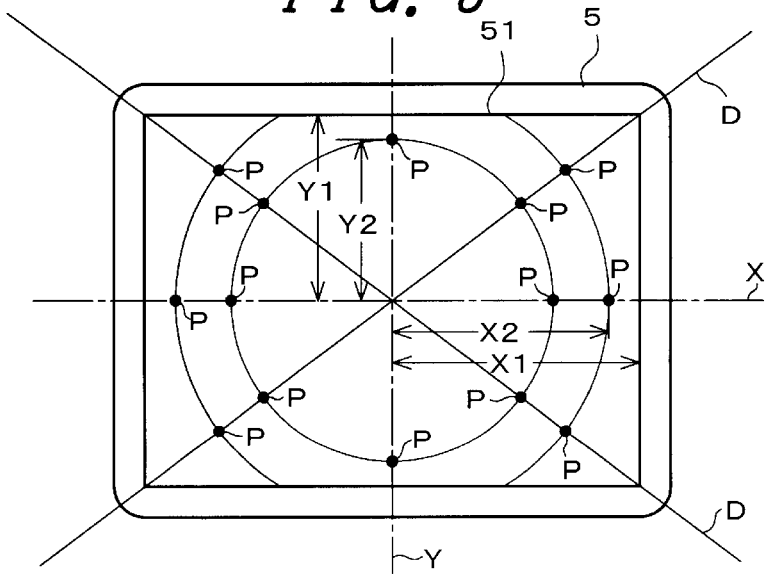
FIG. 8 shows an example of positions on the major, minor, and diagonal axes where a radius of curvature is to be checked.

More specifically, it is preferable that the radii of curvature on the respective axes at positions having the same distance from the shadow mask center be such that the radio between the minimum radius of curvature to the maximum radius of curvature is greater than or equal to 0.9. FIG. 8 shows positions P where a radius of curvature is to be checked. In comparing radii of curvature on the major axis X, minor axis Y, and diagonal axis D, radii of curvature are checked at the shadow mask center and the positions that are distant from the shadow mask center by 90% of the shadow mask effective size (one side) on the minor axis, that is, at the shadow mask center and the positions where Y2/Y1=0.9 is satisfied (see FIG. 8). In comparing radii of curvature on the major axis and the diagonal axis, radii of curvature are checked at the shadow mask center and the positions that are distant from the shadow mask center by 90% of the shadow mask effective size (one side) on the major axis, that is, at the shadow mask center and the positions where X2/X1=0.9 is satisfied (see FIG. 8).

The employment of the above surface can prevent the shadow mask from having an unnatural curved surface portion and thereby increase its strength.

Figure 9:
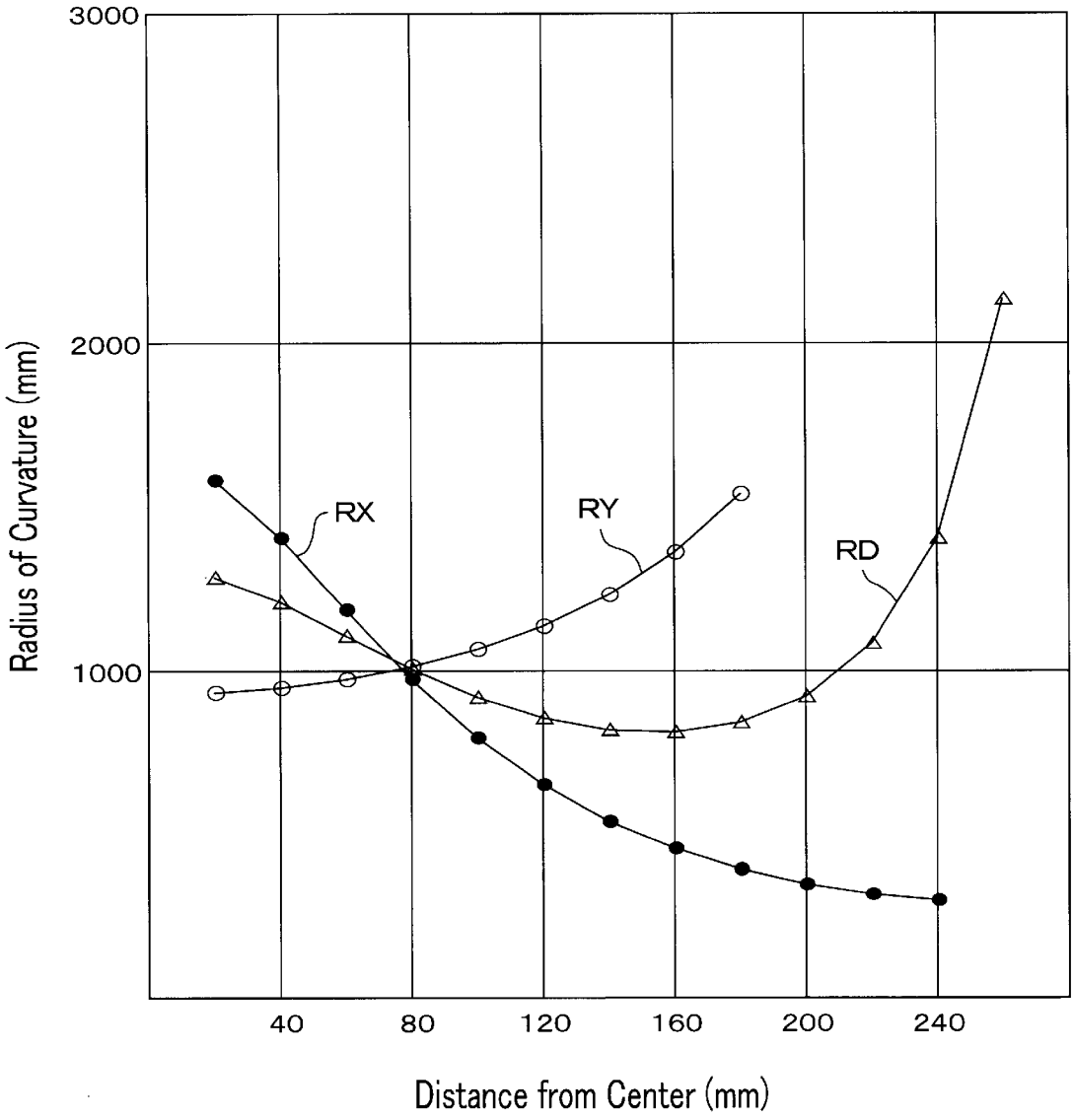
FIG. 9 shows an example of a conventional shadow mask curved surface.

For comparison with the invention, FIG. 9 is a plot of variations of the radii of curvature in the major, minor, and diagonal axes of the shadow mask of a TV picture tube that uses a conventional 24 inches (screen diagonal size) panel having a round face. In FIG. 9, symbols RX, RY, and RD denote radius-of-curvature curves on the major axis, minor axis, and diagonal axis, respectively.

There are marked differences between the shadow mask according to the invention shown in FIGS. 5–7 and the conventional shadow mask shown in FIG. 9.

In general, conventional color picture tube designing is such that a panel is designed first and a shadow mask curved surface is designed based on the panel inside surface so that phosphor dots are arranged closely. However, it is difficult for this designing method to produce a shadow mask surface according to the invention as described above.

The invention can be practiced more easily by designing a shadow mask first so as to secure sufficient shadow mask strength and then designing a panel inside surface based on the shadow mask thus designed. In color display tubes that are used in computer terminals, the curved surface Zi of the panel inside surface at a position (X, Y) is defined by the following equation:

$$Zi(X, Y)=Rx-\sqrt{[\{Rx-Ry+\sqrt{(Ry^2-Y)}\}^2-X^2]}$$

Zi(X, Y) is the drop on a line parallel with a tube axis from the height at the panel center, Rx is the radius of curvature on a line parallel with the major axis and Ry is the radius of curvature on a line parallel with the minor axis.

To realize a shadow mask according to the invention, a certain limitation should be imposed on the relationship between Rx and Ry. The relationship between the panel inside surface and the shadow mask curved surface depends on the horizontal pitch of the apertures of the shadow mask. The curvature of the shadow mask can be made larger than that of the panel inside surface by making the horizontal pitch of the shadow mask apertures at the periphery larger than that at the mask center. However, increasing the shadow mask pitch lowers the resolution. Where the difference between the shadow mask pitch at the center and that at the periphery should be within 20%, the ratio of Rx to Ry needs to satisfy the following relationship:

$$0.64 \leq Ry/Rx \leq 0.86.$$

This makes it possible to realize a color cathode ray tube in which the shadow mask is sufficiently strong for practical use and the panel outside surface is flat.

Although the embodiment is mainly directed to the color CRT for a computer terminal (color display tube), naturally the invention can also be applied to TV color picture tubes having a flat panel outside surface.

What is claimed is:

1. A color cathode ray tube comprising:

a panel in which an outside surface has a curved surface that is substantially flat with an equivalent radius of curvature on a diagonal axis being greater than or equal to 10,000 mm and an inside surface has a curved surface that is convex toward the outside surface; and a shadow mask provided so as to be opposed to the inside surface of the panel, the shadow mask being generally rectangular and having radii of curvature along a diagonal axis, such that the radius of curvature decreases approximately linearly between a center of the shadow mask and a periphery along the diagonal axis, and where a relationship between radii of curvature and corresponding distances from the center of the shadow mask on the diagonal axis is approximated by a first linear expression according to the least-squares method, differences between the radii of curvature and results of the linear expression are smaller than or equal to 100 mm.

2. A color cathode ray tube according to claim 1, wherein a relationship between radii of curvature on a major axis and corresponding distances from the center of the shadow mask on the major axis is approximated by a second linear expression according to the least-squares method, and differences between the radii of curvature and results of the second linear expression are smaller than or equal to 100 mm.

3. A color cathode ray tube according to claim 2, wherein a relationship between radii of curvature on a minor axis and distances from the center of the shadow mask on the minor axis is approximated by a third linear expression according to the least-squares method, and differences between the radii of curvature and results of the third linear expression are smaller than or equal to 100 mm.

4. A color cathode ray tube comprising:

a panel in which an outside surface has a curved surface that is substantially flat with an equivalent radius of curvature on a diagonal axis being greater than or equal to 10,000 mm and an inside surface has a curved surface that is convex toward the outside surface; and a shadow mask provided so as to be opposed to the inside surface of the panel, the shadow mask being generally rectangular and having such a curved surface that a radius of curvature decreases approximately linearly between a center of the shadow mask and a periphery, and that among absolute values of slopes a, b, and c of straight lines each obtained by a linear expression approximating radius of curvature variations on a major axis, a minor axis, and a diagonal axis according to the least-squares method, respectively, the absolute value of slope c on the diagonal axis is the largest.

5. A color cathode ray tube according to claim 4, wherein a relationship c>a>b holds.

6. A color cathode ray tube comprising:

a panel in which an outside surface has a curved surface that is substantially flat with equivalent radius of curvature on a diagonal axis being greater than or equal to 10,000 mm and an inside surface has a curved surface that is convex toward the outside surface; and a shadow mask provided so as to be opposed to the inside surface of the panel, the shadow mask being generally rectangular and having such a curved surface that a radius of curvature decreases approximately linearly between a center of the shadow mask and a periphery, and that among absolute values of slopes a, b, and c of straight lines each obtained by a linear expression approximating radius-of-curvature variations on a major axis, a minor axis, and a diagonal axis according to the least-squares method, respectively, the absolute value of slope c is smaller than or equal to 3.0.

7. A color ray tube according to claim 6, wherein all of a, b, and c are smaller than or equal to 3.0.

8. A color cathode ray tube comprising:

a panel in which an outside surface has a curved surface that is substantially flat with an equivalent radius of curvature on a diagonal axis being greater than or equal to 10,000 mm and an inside surface has a curved surface that is convex toward the outside surface; and a shadow mask provided so as to be opposed to the inside surface of the panel, the shadow mask being generally rectangular and having such a curved surface that respective radii of curvature on a major axis and a minor axis decrease gradually as the position moves from a center of the shadow mask to a periphery, and that at the center of the shadow mask the radius of curvature on the minor axis is smaller than that on the major axis.

9. A color cathode ray tube according to claim 8, wherein at the center of the shadow mask a ratio of the radius of curvature on the minor axis to that on the major axis is smaller than or equal to 0.95.

10. A color cathode ray tube according to claim 8, wherein at the center of the shadow mask a ratio of the radius of curvature on the minor axis to that on the major axis is greater than or equal to 0.90.

11. A color cathode ray tube according to claim 9, wherein at the center of the shadow mask a ratio of the radius of curvature on the minor axis to that on the major axis is greater than or equal to 0.90.

12. A color cathode ray tube comprising:

a panel in which an outside surface has a curved surface that is substantially flat with an equivalent radius of curvature on a diagonal axis being greater than or equal to 10,000 mm and an inside surface has a curved surface that is convex toward the outside surface; and a shadow mask provided so as to be opposed to the inside surface of the panel, the shadow mask being generally rectangular and having such a curved surface that respective radii of curvature on a major axis, a minor axis, and a diagonal axis decrease gradually as the position moves from a center of the shadow mask to a periphery, and that a ratio of a minimum radius of curvature to a maximum radius of curvature among respective radii of curvatures on the major axis, the minor axis, and the diagonal axis at positions having an equal distance from the center of the shadow mask is greater than or equal to 0.9.

13. A color cathode ray tube according to claim 12, wherein a ratio of a minimum radius of curvature to a maximum radius of curvature among respective radii of curvatures on the major axis, the minor axis, and the diagonal axis at positions distant from the center of the shadow mask by 90% of a one-side effective size of the shadow mask in the minor axis direction is greater than or equal to 0.9.

14. A color cathode ray tube according to claim 12, wherein a ratio of a smaller one to a larger one of respective radii of curvatures on the major axis and the diagonal axis at positions distant from the center of the shadow mask by 90% of a one-side effective size of the shadow mask in the major axis direction is greater than or equal to 0.9.

15. A color cathode ray tube comprising:

a panel in which an outside surface has a curved surface that is substantially flat with an equivalent radius of curvature on a diagonal axis being greater than or equal to 10,000 mm and an inside surface has a curved surface that is convex toward the outside surface, the curved surface of the inside surface at a position (X, Y) being expressed by $$Zi(X, Y)=Rx-\sqrt{[\{Rx-Ry+\sqrt{(Ry^2-Y^2)}\}^2-X^2]}$$

where Zi(X, Y) is a drop on a line parallel with a tube axis from a height at a center of the panel, Rx is a radius of curvature on a line parallel with a major axis and Ry is a radius of curvature on a line parallel with a minor axis and a relationship $$0.64 \leqq Ry/Rx \leqq 0.86$$

holds; and a shadow mask provided so as to be opposed to the inside surface of the panel, the shadow mask being generally rectangular and having such a curved surface that respective radii of curvature on the major axis, the minor axis, and a diagonal axis decrease gradually as the position moves from a center of the shadow mask to a periphery.

16. A color cathode ray tube according to claim 15, wherein the shadow mask has a number of apertures in an effective area and a horizontal pitch of the apertures in a peripheral portion of the shadow mask on the major axis is larger than that in a central portion of the shadow mask.

17. A color cathode ray tube according to claim 16, wherein the horizontal pitch of the apertures in the peripheral portion of the shadow mask on the major axis is larger than that in the central portion of the shadow mask by a value that is within 20% of the horizontal pitch of the apertures in the central portion.

* * * * *